US005100345A

United States Patent [19]

Endo et al.

[11] Patent Number: 5,100,345

[45] Date of Patent: Mar. 31, 1992

[54] CONNECTOR WITH A TERMINAL LOCKING BLOCK

[75] Inventors: Takayoshi Endo; Hitoshi Saito; Kimihiro Abe, all of Shizuoka, Japan

[73] Assignee: Yazaki Corporation, Tokyo, Japan

[21] Appl. No.: 680,368

[22] Filed: Apr. 4, 1991

[30] Foreign Application Priority Data

Apr. 10, 1990 [JP] Japan ..... 2-37670[U]

[51] Int. Cl.[5] ..... H01R 13/40

[52] U.S. Cl. ..... 439/595; 439/592; 439/598; 439/752

[58] Field of Search ..... 439/592, 594, 595, 598, 439/599, 752

[56] References Cited

U.S. PATENT DOCUMENTS

| | | | |
|---|---|---|---|
| 4,758,182 | 7/1988 | Tsugioanbo et al. | 439/592 |
| 4,767,361 | 8/1988 | Hoshino et al. | 439/596 |
| 4,867,705 | 9/1989 | Yuasa | 439/595 |
| 4,902,247 | 2/1990 | Suzuki et al. | 439/598 |
| 4,921,448 | 5/1990 | Endo et al. | 439/592 |
| 4,973,268 | 11/1990 | Smith et al. | 439/595 |

FOREIGN PATENT DOCUMENTS

| | | |
|---|---|---|
| 56-51272 | 5/1981 | Japan . |
| 56-57483 | 5/1981 | Japan . |
| 56-167282 | 12/1981 | Japan . |

*Primary Examiner*—Paula A. Bradley
*Attorney, Agent, or Firm*—Krass & Young

[57] ABSTRACT

The terminal locking block is mounted to the connector housing in two steps, first in a provisional engagement condition and then in a full engagement condition. In the provisional engagement condition, a stopper formed at the rear inside of the terminal locking block stays out of terminal insertion passages, allowing terminal lugs to be inserted into the terminal accommodating chambers, in which the terminal lugs are held by resilient engagement pieces of the connector housing. When the terminal locking block is pushed down and advanced forwardly into the full engagement condition, the stopper is situated immediately behind protrusions of the terminal lugs, thus securely locking them. When it is desired to remove the terminal lugs from the connector housing, the terminal locking block is retracted to the provisional engagement condition and the resilient engagement piece is pried open by a jig to disengage the terminal lug. At this time, a restraining projection formed at the front inside of the terminal locking block prevents the resilient engagement piece from being deflected too much, thus protecting it from being broken.

6 Claims, 8 Drawing Sheets

CONNECTOR WITH A TERMINAL LOCKING BLOCK

BACKGROUND OF THE INVENTION

1. Field of the Invention

The present invention relates to a connector used for connecting wiring harnesses and more particularly to a connector structure having a terminal locking block mounted to a connector housing for secure locking of terminal lugs inserted into the connector housing.

2. Prior Art

In FIGS. 7, 8*a* and 8*b*, a connector housing a formed of synthetic resin has a plurality of terminal accommodating chambers b arranged in upper and lower tiers. Each of the terminal accommodating chambers b has its top and bottom outer walls c cut with slits $c_1$ to form a resilient engagement piece d that is to engage with the terminal lug. Terminal lugs e are inserted from behind into the terminal accommodating chambers b until they are held by the resilient engagement pieces d. Then to make the terminal lug engagement more reliable, terminal locking blocks f are placed on the top and bottom walls of the connector housing a and pushed into engagement with them by engaging engagement arms $f_1$ with projections g so that locking projections h formed on the terminal locking blocks f advance into the terminal accommodating chambers b through windows $c_2$ to support engagement projections $d_1$ formed at the free end of the resilient engagement pieces d.

In the above-mentioned conventional connector, with the terminal locking block f dismounted, the terminal lug e is inserted into the terminal accommodating chamber b to be engaged with the resilient engagement piece d. Hence, it is possible to check through the window $c_2$ if the terminal lug c is completely inserted. On the other hand, the prior art connector has the drawback that an assembly worker may forget to attach the terminal locking block f, which is completely separate from the connector housing a. Furthermore, the attaching of the terminal locking block f to the connector housing a is not an easy work.

Another drawback is that, as shown in FIG. 9, when a jig i is used to force up the resilient engagement piece d to disengage the terminal lug e and pull it back from the connector housing, the assembly worker may easily pry open the resilient engagement d excessively as shown by a broken line, which may result in breakage.

SUMMARY OF THE INVENTION

The present invention has been accomplished to overcome the above drawbacks and its objective is to provide a connector with a terminal locking block that makes it possible to check from outside the complete insertion of the terminal lugs with the terminal locking block attached to the connector housing and which, when the resilient engagement piece is pried open by a jig to disengage the terminal lug, prevents the resilient engagement piece from being excessively displaced and broken.

To achieve the above objective, a connector of this invention comprises: a connector housing having terminal accommodating chambers and resilient engagement pieces, said resilient engagement pieces being adapted to engage with terminal lugs inserted into the terminal accommodating chambers; and a terminal locking block mounted to the connector housing in two steps, first in a provisional engagement condition and then in a full engagement condition, said terminal locking block having a stopper, said stopper allowing the terminal lugs to be inserted into the terminal accommodating chambers when the terminal locking block is in the provisional engagement condition and being positioned immediately behind the terminal lugs when the terminal locking block is in the full engagement condition, said terminal locking block allowing an assembly worker to check from outside the engaged condition of the terminal lugs with the resilient engagement pieces in the terminal accommodating chambers when the terminal locking block is in the provisional engagement condition, in which condition the terminal locking block leaves the terminal accommodating chambers open to external view, said terminal locking block also being adapted to prevent the resilient engagement pieces from being deflected excessively when it is in the provisional engagement condition.

BRIEF DESCRIPTION OF THE DRAWINGS

FIGS. 2*a* and 2*b* are cross sections of. FIG. 1, with FIG. 2*a* showing the terminal locking block provisionally engaged with the connector housing and FIG. 2*b* showing it fully engaged;

PREFERRED EMBODIMENT OF THE INVENTION

Figure 1A:
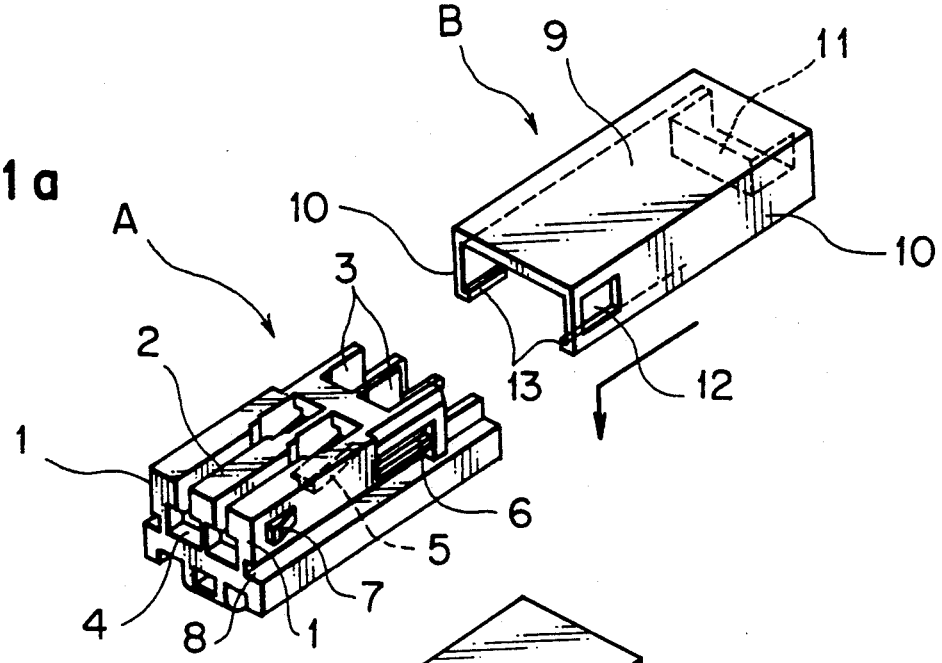
FIGS. 1*a* to 1*c* are perspective views of one embodiment of this invention, with FIG. 1*a* showing a terminal locking block separated from a connector housing, FIG. 1*b* showing the terminal locking block provisionally engaged with the connector housing, and FIG. 1*c* showing the terminal locking block fully engaged.

In FIGS. 1 and 2, A is a connector housing and B is a terminal locking block, both formed of synthetic resin as one piece.

The connector housing A has terminal accommodating chambers 3 formed between side walls 1 on each side and an intermediate wall 2. The terminal accommodating chambers 3 are open at the top and have a stopper 4 at the front end thereof and a resilient engagement piece 5 at an intermediate portion thereof. The side walls 1 have a provisional engagement groove 6 formed at the rear portion thereof and a full engagement projection 7 at the front portion thereof. The side walls also have a guide groove 8 extending longitudinally.

The U-shaped terminal locking block B consists of a main plate portion 9 and side plate portions 10, both formed integrally as one piece. At the rear inside of the main plate portion 9, there is provided a stopper 10 that will engage with the terminal lug C. At the front end of the side plate portion 10 is formed a full engagement hole 12, below which an inwardly protruding provisional engagement projection 13 is formed.

Figure 1B:
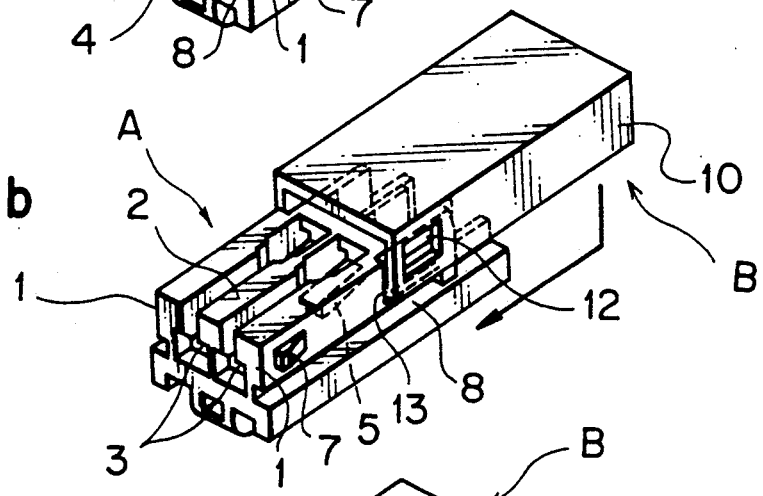
Figure 2A:
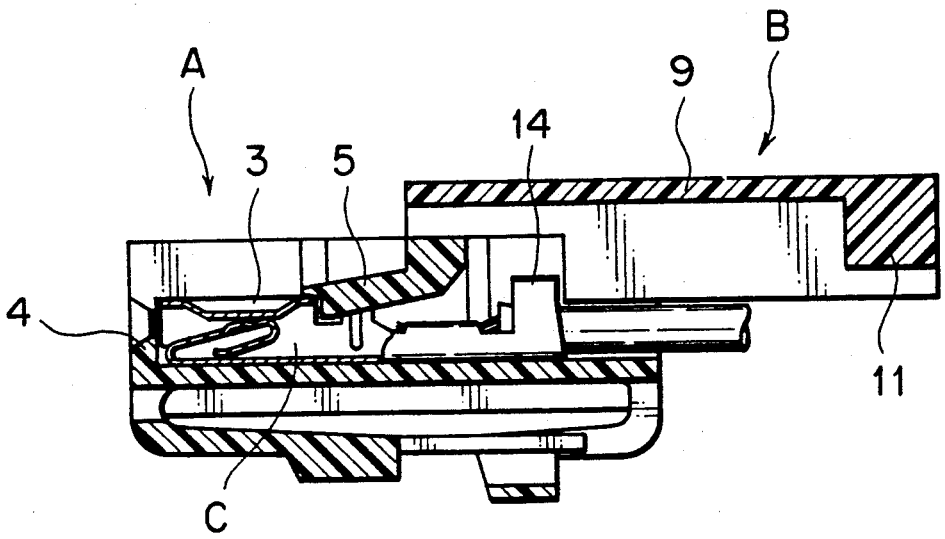

In the above construction, the terminal locking block B is at first provisionally engaged with the connector housing A. In this condition, the provisional engagement projections 13 of the terminal locking block B are fitted in the provisional engagement grooves 6 of the connector housing A so that the terminal locking block B is at a raised position at the rear of the connector housing A (FIG. 1*b*). In this provisionally engaged condition, the stopper 11 stays out of passages through which the terminal lugs C are inserted into the terminal accommodating chambers, allowing the terminal lugs C to be pushed into the terminal accommodating chambers 3 and held by the resilient engagement pieces 5 (FIG. 2*a*). The engagement of the terminal lugs can be seen from above through the open upper portion of the terminal accommodating chambers.

Figure 1C:
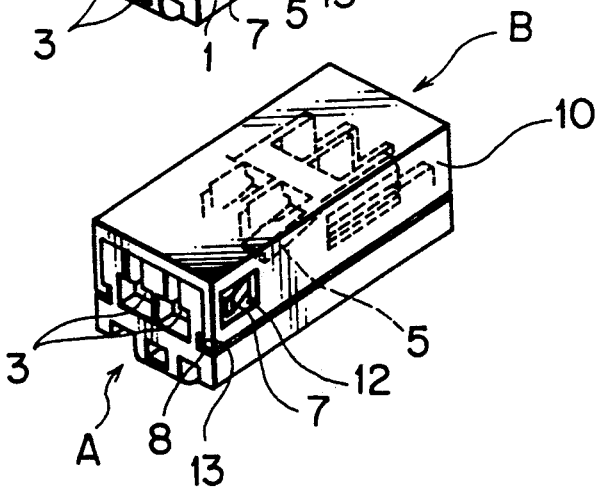
Figure 2B:
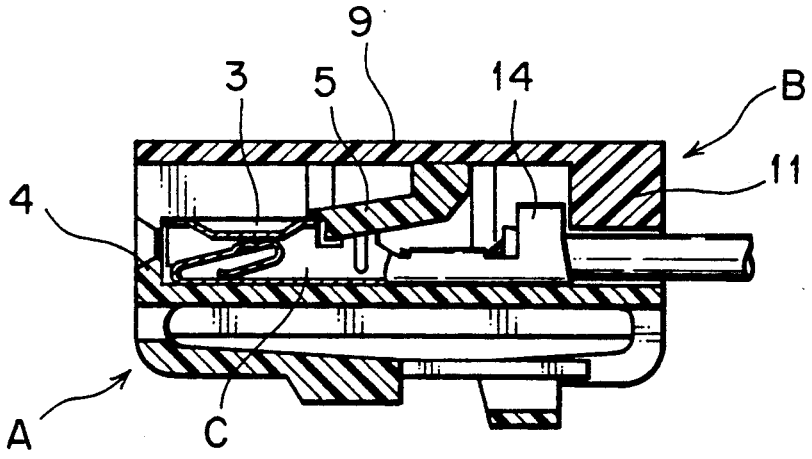

Next, the terminal locking block B is pushed down to shift the provisional engagement projections 13 from the provisional engagement grooves 6 into the guide grooves 8. Then the terminal locking block B is advanced forwardly to connect the full engagement holes 12 with the full engagement projections 7 to assume a fully engaged condition (FIG. 1*c*). In this state, the stopper 11 is positioned immediately behind a protrusion 14 of the terminal lug C, thus preventing the terminal lug C from slipping off backwardly (FIG. 2*b*). The backward slip-off of the terminal lug is therefore doubly blocked by the resilient engagement piece 5 and the stopper 11.

Figure 3A:
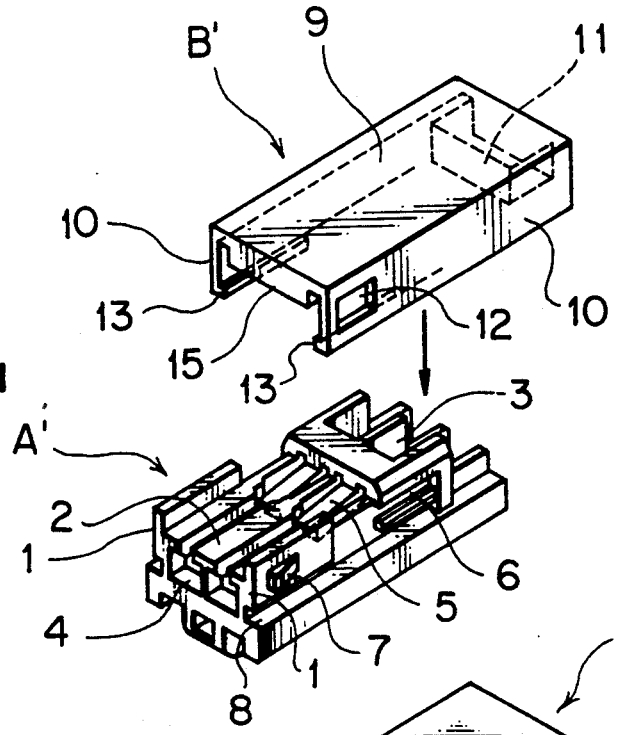
FIGS. 3*a* to 3*c* are perspective views of a second embodiment of this invention, with FIG. 3*a* showing the terminal locking block separated from the connector housing, FIG. 3*b* showing the terminal locking block provisionally engaged with the connector housing, and FIG. 3*c* showing the terminal locking block fully engaged.
Figure 3B:
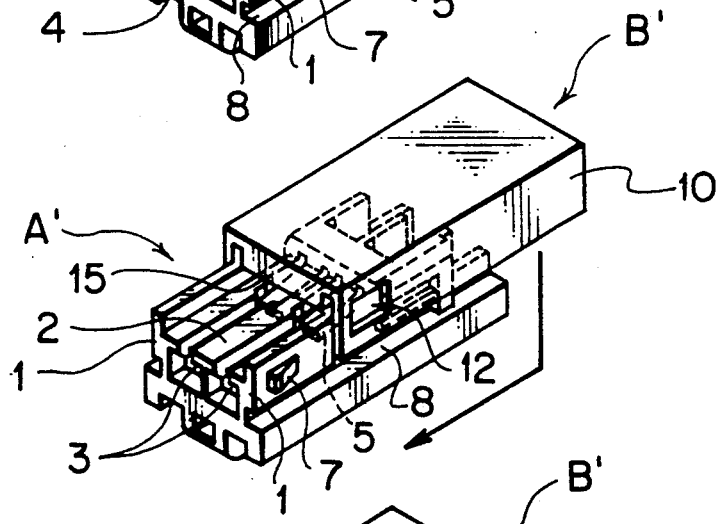
Figure 3C:
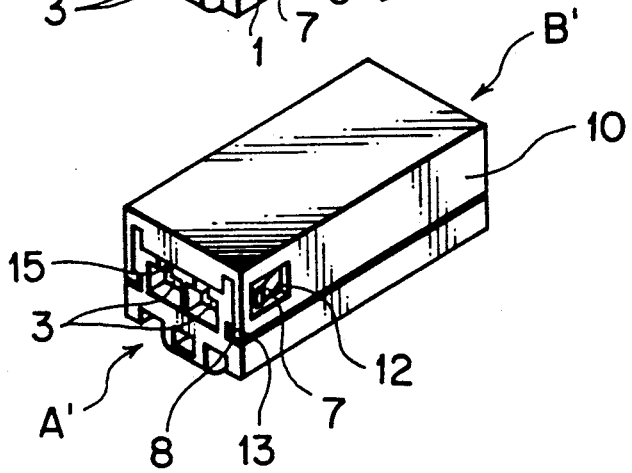
Figure 4A:
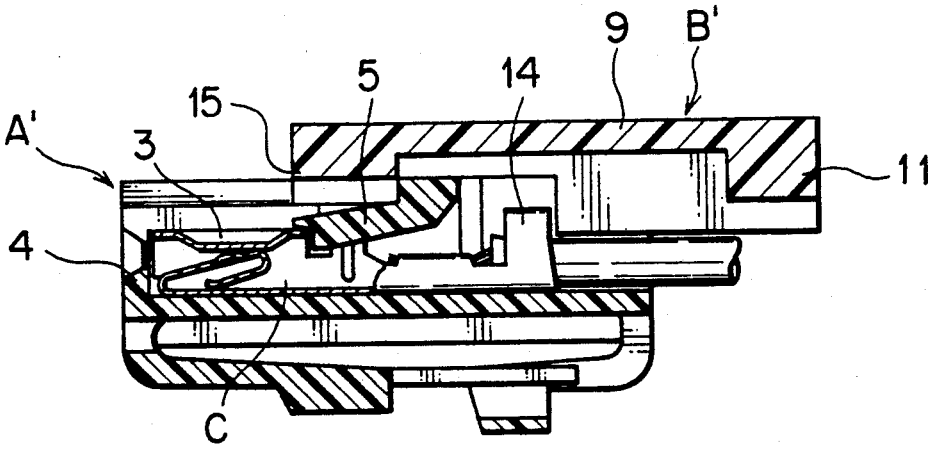
FIGS. 4*a* to 4*c* are cross sections of FIG. 3, with FIG. 4*a* showing the terminal locking block provisionally engaged with the connector housing, FIG. 4*b* showing it fully engaged, and FIG. 4*c* showing the terminal lug disengaged by a jig.
Figure 4B:
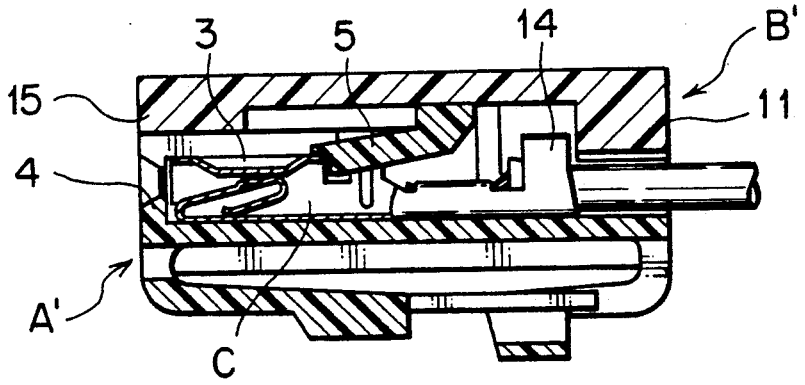

In the second embodiment of FIGS. 3 and 4, a restraining projection 15 is provided to the front inner side of the main plate portion 9 of the terminal locking block B'. In a provisionally engaged condition in which the provisional engagement projections 13 of the terminal grooves 6 of the connector housing A', the restraining projection 15 stays above the resilient engagement pieces 5 with a gap therebetween (FIG. 3*b*, FIG. 4*a*). From this state the terminal locking block B' is pressed down and advanced into the full engagement state (FIG. 3*c*, FIG. 4*b*) as in the preceding embodiment.

Figure 4C:
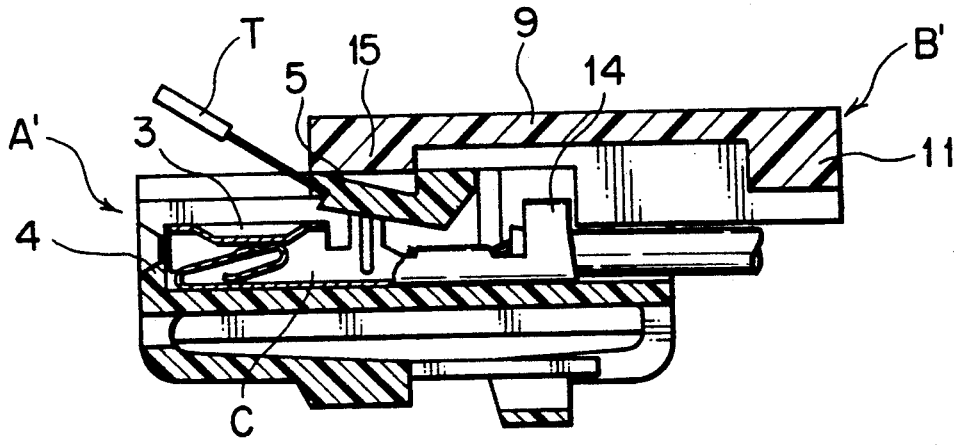

When the terminal lugs C are to be removed, the terminal locking block B' is returned to the provisional engagement condition and then the resilient engagement pieces 5 are pried up by a jig T to disengage the terminal lug C. At this time, the restraining projection 15 prevents the resilient engagement piece 5 from being displaced excessively to protect it from damage (FIG. 4*c*).

Figure 5A:
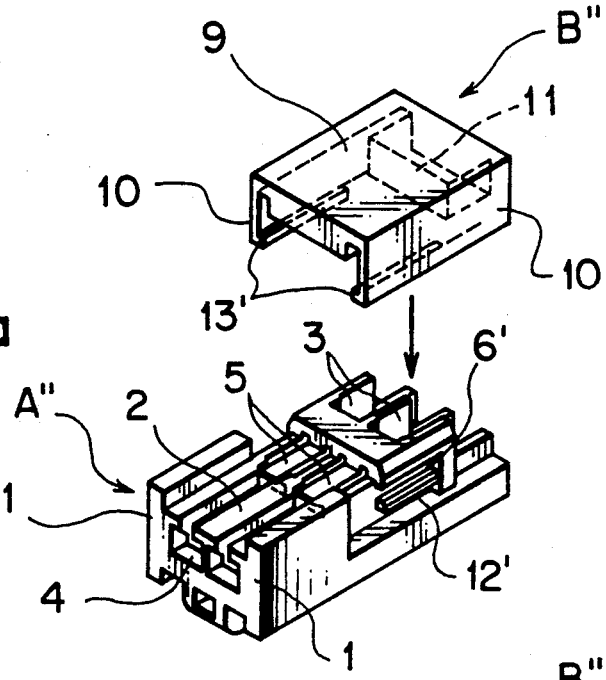
FIGS. 5*a* to 5*c* are perspective views of a third embodiment of this invention, with FIG. 5*a* showing the terminal locking block separated from the connector housing, FIG. 5*b* showing the terminal locking block provisionally engaged with the connector housing, and FIG. 5*c* showing the terminal locking block fully engaged.
Figure 5B:
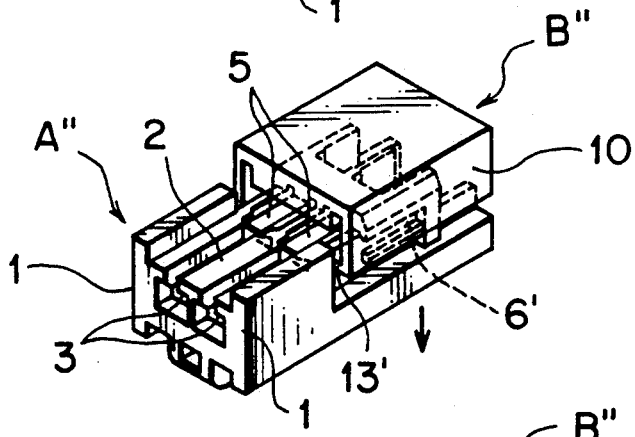
Figure 5C:
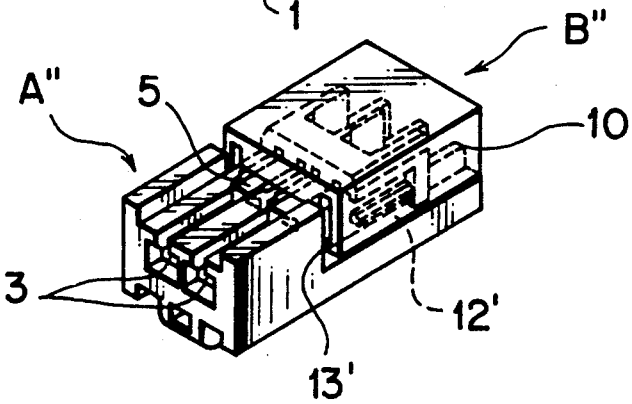
Figure 6A:
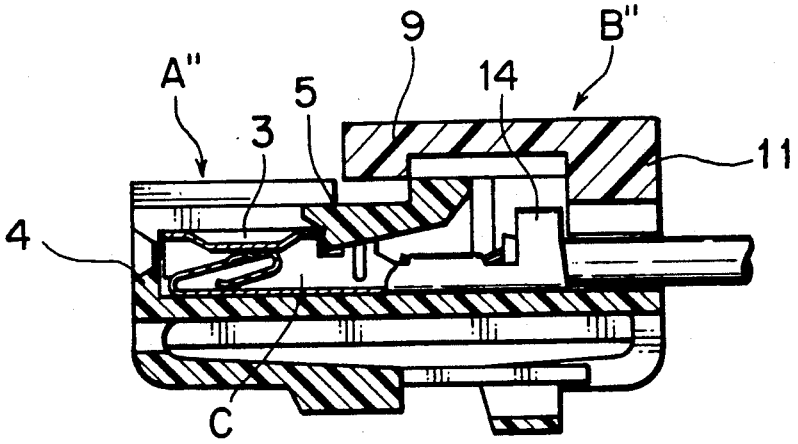
FIGS. 6*a* to 6*c* are cross sections of FIG. 5, with FIG. 6*a* showing the terminal locking block provisionally engaged with the connector housing, FIG. 6*b* showing it fully engaged, and FIG. 6*c* showing the terminal lug disengaged by the jig.
Figure 6B:
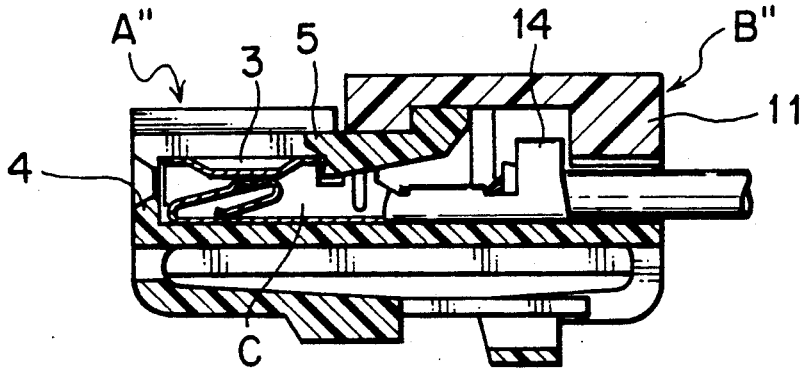

In the third embodiment of FIGS. 5 and 6, the engagement projections 13' of the terminal locking block B'' are made engageable with and disengageable from provisional engagement grooves 6' and full engagement grooves 12', that are formed in two tiers in the side walls 1 of the connector housing A''. Pushing down the terminal locking block B'' from the provisional engagement condition (FIG. 5*b*, FIG. 6*a*) immediately sets it into the full engagement condition (FIG. 5*c*, FIG. 6*b*).

Figure 6C:
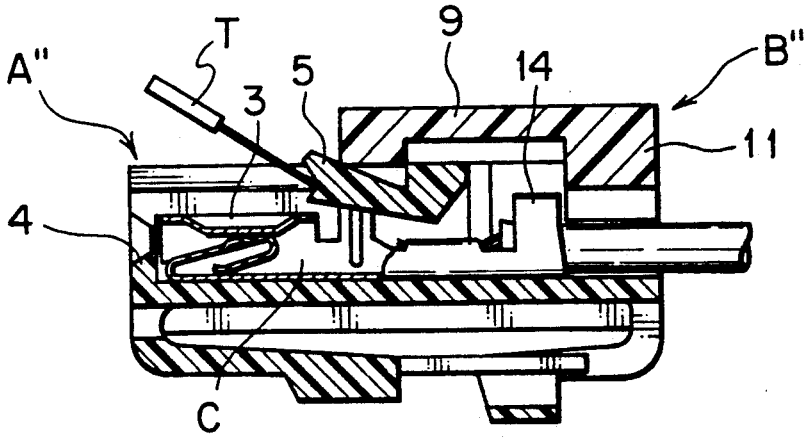
Figure 7:
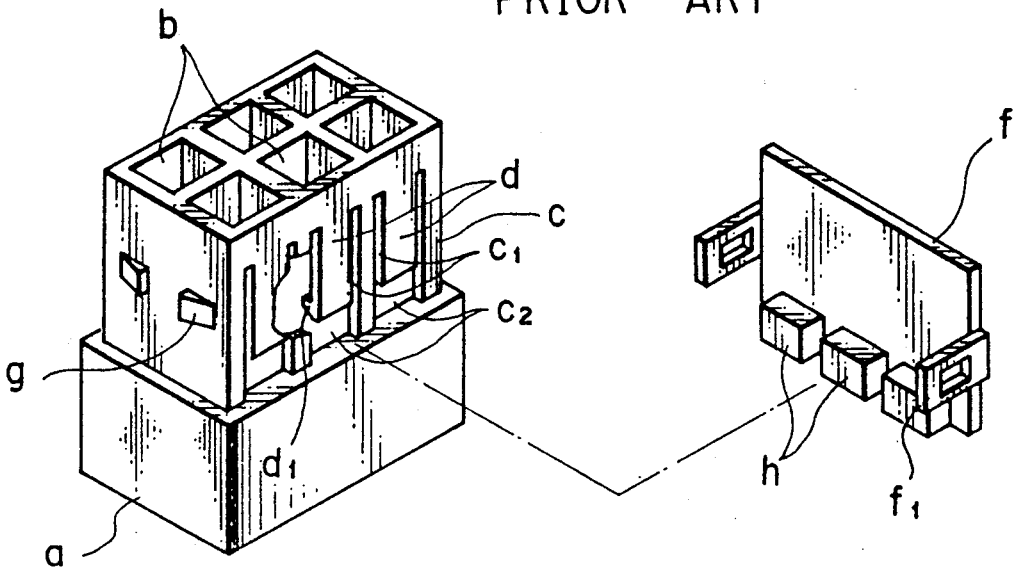
FIG. 7 PRIOR ART
FIG. 7 is a perspective view of a conventional connector housing with a terminal locking block separated.
Figure 9:
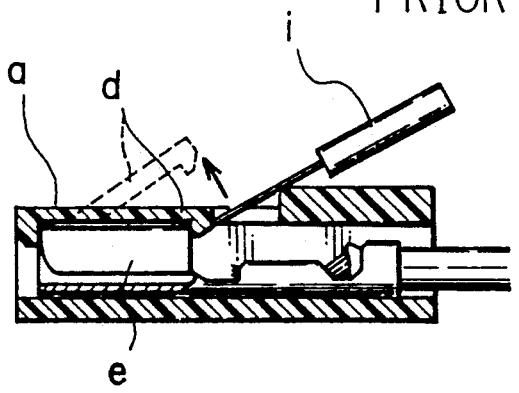
FIG. 9 PRIOR ART
FIG. 9 is a cross section of FIG. 7 showing the terminal lug being disengaged.
Figure 8A:
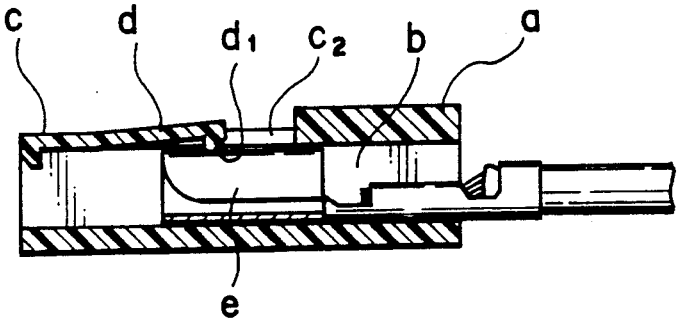
FIG. 8a PRIOR ART
FIGS. 8*a* and 8*b* are cross sections of FIG. 7, with FIG. 8*a* showing the terminal lug being inserted into the connector housing and FIG. 8*b* showing the terminal locking block mounted to the connector housing.
Figure 8B:
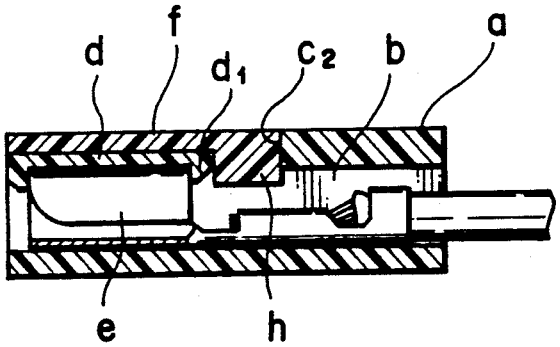
FIG. 8b PRIOR ART

In this embodiment, the condition of the terminal lug C can be checked from outside not only during the provisional engagement condition but also during the full engagement condition. In the provisional engagement condition, the terminal lug C can be disengaged from the resilient engagement piece 5 by lifting the latter using the jig T (FIG. 6*c*).

The construction and advantages of this invention may be summarized as follows.

The terminal locking block is connected to the connector housing containing terminal accommodating chambers in two steps, by first setting the block to a provisional engagement position and then to a full engagement position. The terminal locking block is formed with a stopper for the terminal lugs. The stopper permits insertion of the terminal lugs into the terminal accommodating chambers when the terminal locking block is in the provisional engagement position. In the full engagement condition, the stopper is situated immediately behind the terminal lugs, locking them. In the provisional engagement condition, the upper part of the terminal accommodating chambers are open and not covered by the locking block, so that the engagement between the resilient engagement piece and the terminal lug in the terminal accommodating chamber can be seen from outside. This construction therefore permits visual check on the inserted condition of the terminal lug in the terminal accommodating chamber when the terminal locking block is provisionally engaged with the connector housing, before moving the terminal locking block to the fully engaged position. When the terminal lug is disengaged from the resilient engagement piece when the terminal locking block is in the provisional engagement position, the restraining projection formed at the front of the terminal locking block prevents the resilient engagement piece from being deflected excessively thus protecting it from damage.

What is claimed is:

1. A connector with a terminal locking block comprising:

a connector housing having terminal accommodating chambers and resilient engagement pieces, said resilient engagement pieces being adapted to engage with terminal lugs inserted into the terminal accommodating chambers; and a terminal locking block mounted to the connector housing in two steps, first in a provisional engagement condition and then in a full engagement condition, said terminal locking block having a stopper, said stopper allowing the terminal lugs to be inserted into the terminal accommodating chambers when the terminal locking block is in the provisional engagement condition and being positioned immediately behind the terminal lugs when the terminal locking block is in the full engagement condition, said terminal locking block allowing an assembly worker to check from outside the engaged condition of the terminal lugs with the resilient engagement pieces in the terminal accommodating chambers when the terminal locking block is in the provisional engagement condition, in which condition the terminal locking block leaves the terminal accommodating chambers open to external view.

2. A connector with a terminal locking block comprising:

a connector housing having terminal accommodating chambers and resilient engagement pieces, said resilient engagement pieces being adapted to engage with terminal lugs inserted into the terminal accommodating chambers; and a terminal locking block mounted to the connector housing in two steps, first in a provisional engagement condition and then in a full engagement condition, said terminal locking block having a stopper, said stopper allowing the terminal lugs to be inserted into the terminal accommodating chambers when the terminal locking block is in the provisional engagement condition and being positioned immediately behind the terminal lugs when the terminal locking block is in the full engagement condition, said terminal locking block allowing an assembly worker to check from outside the engaged condition of the terminal lugs with the resilient engagement pieces in the terminal accommodating chambers when the terminal locking block is in the provisional engagement condition, in which condition the terminal locking block leaves the terminal accommodating chambers open to external view, said terminal locking block also being adapted to prevent the resilient engagement pieces from being deflected excessively when it is in the provisional engagement condition.

3. A connector with a terminal locking block as claimed in claim 2, wherein the prevention of the resilient engagement pieces from being deflected excessively when the terminal locking block is in the provisional engagement condition is accomplished by a restraining projection formed at the front end of the terminal locking block

4. A connector with a terminal locking block as claimed in claim 1, wherein the shift of the terminal locking block from the provisional engagement condition to the full engagement condition is achieved by first pushing down the terminal locking block and then advancing it forwardly.

5. A connector with a terminal locking block as claimed in claim 1, wherein the shift of the terminal locking block from the provisional engagement condition to the full engagement condition is achieved by simply pushing down the terminal locking block.

6. A connector with a terminal locking block as claimed in claim 5, wherein said terminal locking block does not enclose the upper part of the terminal accommodating chambers when the terminal locking block is set in the full engagement condition o the connector housing.

* * * * *